US010053330B2

(12) United States Patent
Son

(10) Patent No.: US 10,053,330 B2
(45) Date of Patent: Aug. 21, 2018

(54) METHOD FOR CONTROLLING OPERATION OF AN ELEVATOR USING AN AUXILIARY POWER SUPPLY

(71) Applicant: LSIS CO., LTD., Anyang-si, Gyeonggi-do (KR)

(72) Inventor: Ju-Beom Son, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/383,128

(22) Filed: Dec. 19, 2016

(65) Prior Publication Data

US 2017/0210595 A1 Jul. 27, 2017

(30) Foreign Application Priority Data

Jan. 25, 2016 (KR) ..... 10-2016-0008667

(51) Int. Cl.

| | |
|---|---|
| ***B66B 13/14*** | (2006.01) |
| ***B66B 1/30*** | (2006.01) |
| ***B66B 5/00*** | (2006.01) |
| ***B66B 5/02*** | (2006.01) |

(52) U.S. Cl.

CPC ..... *B66B 1/30* (2013.01); *B66B 5/0018* (2013.01); *B66B 5/021* (2013.01); *B66B 5/027* (2013.01); *B66B 2201/34* (2013.01)

(58) Field of Classification Search

USPC ..... 187/247

See application file for complete search history.

(56) References Cited

U.S. PATENT DOCUMENTS 5,945,644 A * 8/1999 Jang ..... B66B 5/02 187/293
6,435,312 B2 * 8/2002 Tajima ..... B66B 1/30 187/290

(Continued)

FOREIGN PATENT DOCUMENTS

JP S53-34245 A 3/1978
JP 5-262470 A 10/1993

(Continued)

OTHER PUBLICATIONS

Japanese office action dated Sep. 26, 2017 for corresponding JP application.

(Continued)

*Primary Examiner* — Christopher Uhlir
(74) *Attorney, Agent, or Firm* — K&L Gates LLP

(57) ABSTRACT

The present invention relates to a method for controlling an operation of an elevator, which is capable of moving the elevator to a near floor by using an auxiliary power supply such as a battery in an emergency situation where a commercial power supply cannot be used, while minimizing power consumption through automatic control. The method includes: detecting the current operation zone of the elevator when an auxiliary power supply driving situation occurs; and operating the elevator by using the auxiliary power supply to correspond to the detected current operation zone. The detected current operation zone corresponds to one of an acceleration zone, a constant speed zone, a creep zone and a seating zone.

1 Claim, 6 Drawing Sheets

(56) References Cited

U.S. PATENT DOCUMENTS

| | | | | |
|---|---|---|---|---|
| 7,909,143 | B2 * | 3/2011 | Tyni | B66B 1/2458 187/247 |
| 2004/0035646 | A1 | 2/2004 | Araki | |
| 2008/0073157 | A1 * | 3/2008 | Kanon | B66B 5/027 187/290 |
| 2010/0187047 | A1 | 7/2010 | Gremaud et al. | |

FOREIGN PATENT DOCUMENTS

| | | | |
|---|---|---|---|
| JP | H1149449 | A | 2/1999 |
| JP | 3028907 | B2 | 2/2000 |
| JP | 2001114482 | A | 4/2001 |
| JP | 2002-137875 | A | 5/2002 |
| JP | 2005126171 | A | 5/2005 |
| JP | 3692376 | B2 | 7/2005 |
| JP | 4062595 | B2 | 1/2008 |
| JP | 4464110 | B2 | 2/2010 |
| JP | 4749854 | B2 | 5/2011 |
| JP | 5338901 | B2 | 8/2013 |
| JP | 2014-118232 | A | 6/2014 |
| WO | 03033390 | A1 | 4/2003 |

OTHER PUBLICATIONS

European Search Report dated Jun. 2, 2017 in connection with the counterpart European Patent Application No. 16203816.0.

* cited by examiner

METHOD FOR CONTROLLING OPERATION OF AN ELEVATOR USING AN AUXILIARY POWER SUPPLY

CROSS REFERENCE TO RELATED APPLICATION

This application claims the benefit of Korean Patent Application No. 10-2016-0008667, filed on Jan. 25, 2016, entitled "METHOD FOR CONTROLLING DRIVING OF ELEVATOR", which is hereby incorporated by reference in its entirety into this application.

BACKGROUND

1. Technical Field

The present invention relates to a method for controlling an operation of an elevator, which is capable of moving the elevator to a near floor by using an auxiliary power supply such as a battery in a situation where a commercial power supply cannot be used, while minimizing power consumption through automatic control.

2. Description of the Related Art

In a case where an elevator cannot be run by a commercial power source due to a sudden emergency situation or the like, the elevator is run using an emergency power source such as an auxiliary battery.

That is, when the commercial power source is stopped, a typical elevator can be moved to a near floor using power of an internal battery by means of manual operation of a user.

However, if the battery capacity left is small and much power is required to move the elevator to the near floor, the elevator may stop due to lack of the battery capacity before it arrives at the target floor, which may be fatal to safety of passengers.

SUMMARY

It is an aspect of the present invention to provide a method for controlling an operation of an elevator, which is capable of moving the elevator to a near floor by using an auxiliary power supply such as a battery in a situation where a commercial power supply cannot be used, while minimizing power consumption through automatic control.

The above and/or other aspects and advantages of the present invention will become apparent and more readily appreciated from the following description of the embodiments, taken in conjunction with the accompanying drawings. It should be understood that the objects and advantages of the present invention can be realized by features and combinations thereof set forth in the claims.

In accordance with one aspect of the present invention, there is provided a method for controlling an operation of an elevator, including: detecting the current operation zone of the elevator when an auxiliary power supply driving situation occurs; and operating the elevator by using the auxiliary power supply to correspond to the detected current operation zone, wherein the detected current operation zone corresponds to one of an acceleration zone, a constant speed zone, a creep zone and a seating zone.

In one embodiment, the method may further include: when the detected current operation zone corresponds to the constant speed zone, measuring an output current in a forward test operation for the elevator; measuring an output current in a backward test operation for the elevator; making a comparison in output current between the forward test operation and the backward test operation and determining an operation direction of the elevator in a direction in which a smaller output current is required; and operating the elevator in the determined operation direction to arrive at a target floor.

In one embodiment, the method may further include: if it is determined that a difference in output current between the forward test operation and the backward test operation falls within a margin of error, determining the operation direction of the elevator as a direction in which the elevator is closer to a near floor, based on position information of the elevator.

In one embodiment, the method may further include: when the detected current operation zone corresponds to the acceleration zone, operating the elevator in a backward direction of the elevator to arrive at a target floor.

In one embodiment, the method may further include: when the detected current operation zone corresponds to one of the creep zone and the seating zone, operating the elevator in a forward direction of the elevator to arrive at a target floor.

According to the present invention, in a situation where an auxiliary power supply such as a battery is used to operate an elevator, by automatically determining an optimal operation direction corresponding to the current operation status of the elevator to move the elevator, it is possible to minimize power consumption of the battery.

In particular, when the elevator is stopped in a constant speed operation condition, by making a comparison in power consumption between the forward test operation and the backward test operation for the elevator and automatically determining the operation direction of the elevator as a direction in which less power consumption is required, it is possible to determine the best reasonable operation direction coping with all operation conditions.

As a result, it is possible to minimize a danger of personal accidents such as safety accidents due to exhaustion of a battery in an emergency power operation of the elevator.

DETAILED DESCRIPTION

Figure 1:
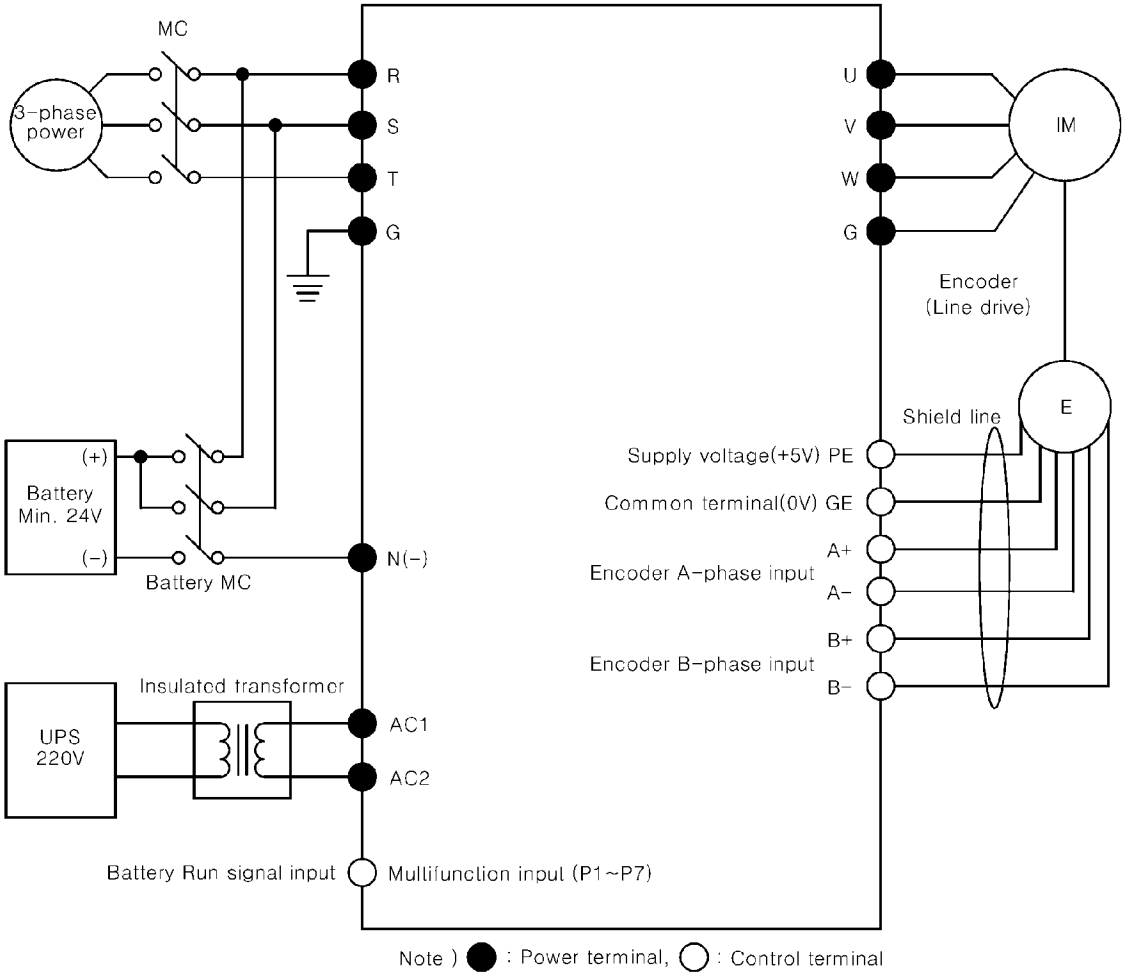
FIG. 1 is a circuit diagram showing the configuration of an inverter applied to an elevator operation control method according to an embodiment of the present invention.

The above objects, features and advantages will become more clearly apparent from the following detailed description in conjunction with the accompanying drawings. Therefore, the technical ideas of the present invention can be easily understood and practiced by those skilled in the art. In the following detailed description of the present invention, concrete description on related functions or constructions will be omitted if it is deemed that the functions and/or constructions may unnecessarily obscure the gist of the present invention.

Hereinafter, preferred embodiments of the present invention will be described in detail with reference to the accompanying drawings. Throughout the drawings, the same or similar elements are denoted by the same reference numerals.

FIG. 1 is a circuit diagram showing the configuration of an inverter applied to an elevator emergency operation control method according to an embodiment of the present invention.

Referring to FIG. 1, an inverter applied to an elevator emergency operation control method according to an embodiment of the present invention is configured to operate a battery connection switch (battery MC) when supply of three-phase input power supplied to the inverter is cut off, that is, in an emergency power situation, so that battery power instead of the three-phase input power is supplied to a powering part of the inverter.

For reference, the term 'emergency situation' or 'emergency power situation' refers to a situation where supply of commercial power using an inverter cannot be properly performed, a situation where an auxiliary power supply such as a battery is used to supply driving power to an elevator, etc. In a situation where supply of commercial power to an elevator cannot be properly performed due to failure or malfunction of equipment, it is natural that any typical method can be applied as a process of supplying driving power using an auxiliary power supply such as a battery according to a preset program.

In such an emergency power situation, an UPS power supply is also operated to supply power to a control part (CPU) of the inverter such that the inverter control part is not turned off.

A typical elevator is stopped when an emergency power situation occurs. Thereafter, supply of power from a battery is performed and then the elevator is moved to a near floor as the elevator restarts to be driven from the moment a driving signal of the elevator is input by manual operation or the like by an operator. In this case, it is common that the driving direction of the elevator is limited to a particular one direction preset according to a programming or the like.

However, in such a configuration, if the elevator is stopped due to lack of the battery capacity before it arrives at the target floor, this may make safety of passengers fatal.

Therefore, the present invention suggests a novel technique for automatically and more safely moving an elevator to a near (target) floor in an emergency situation while minimizing power consumption of a battery.

Figure 2:
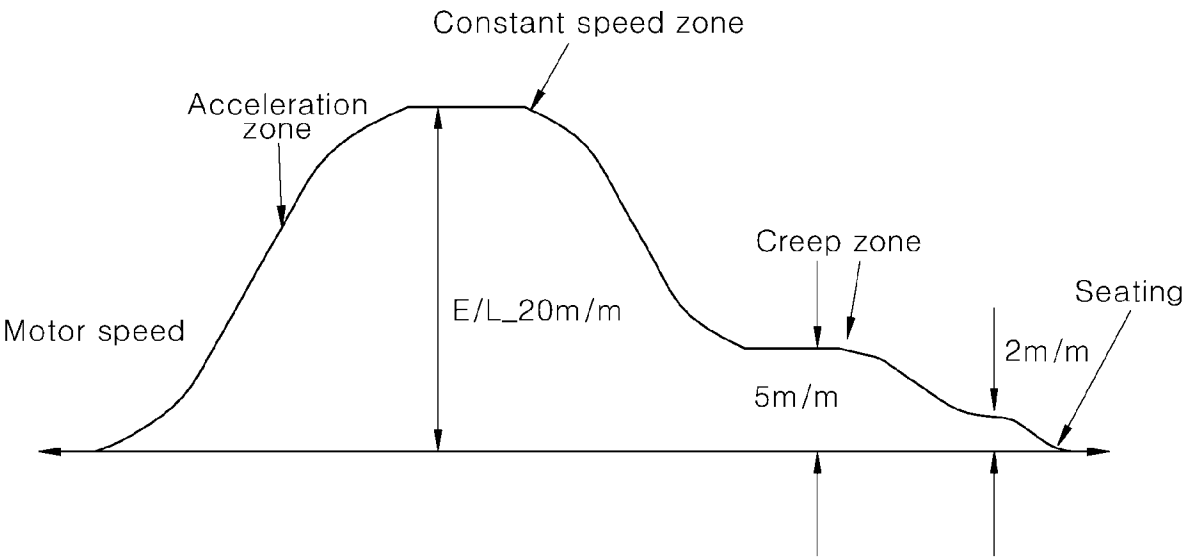
FIG. 2 is a graph used to explain various driving conditions of an elevator.
Figure 3:
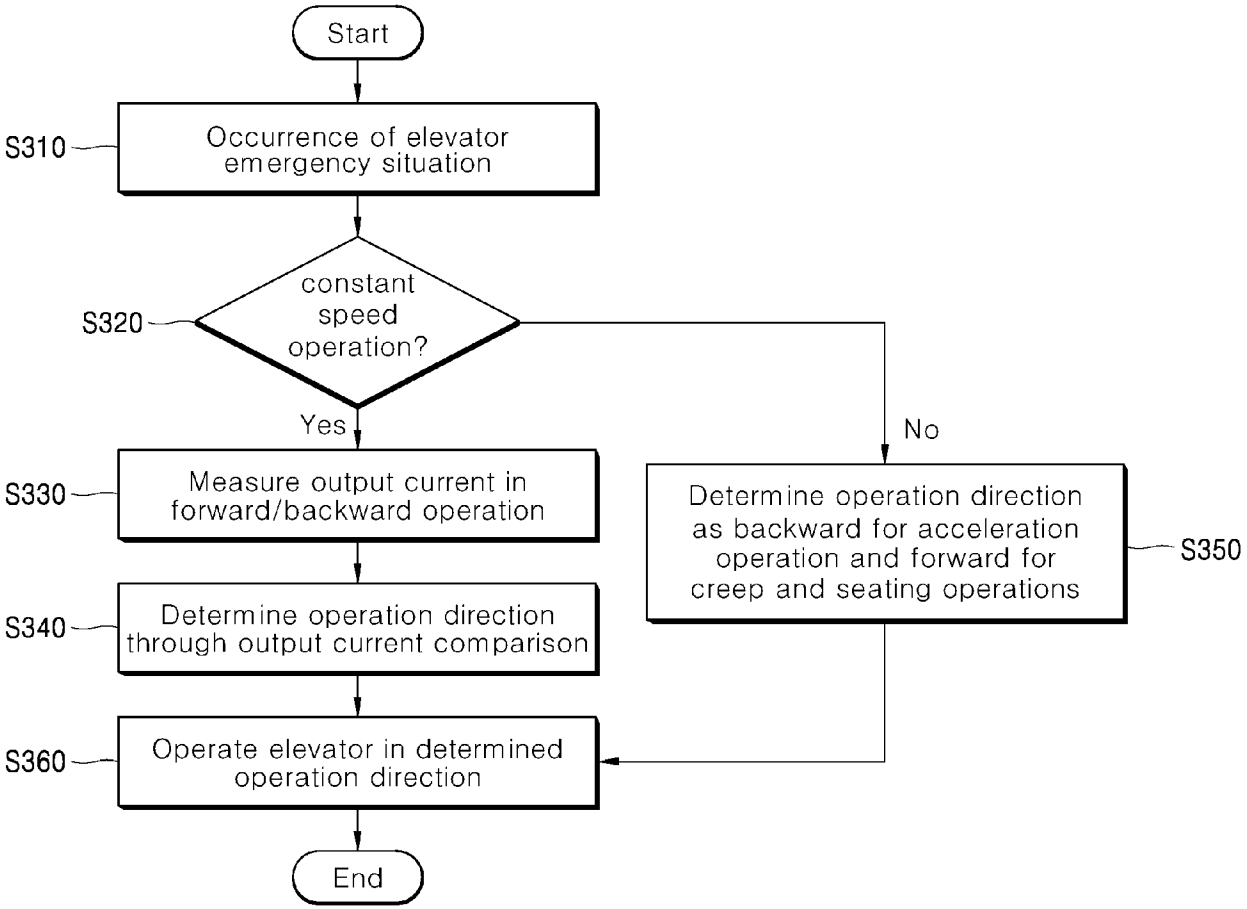
FIG. 3 is a flow chart used to explain an elevator operation control method according to one embodiment of the present invention.

FIG. 2 is a graph used to explain various driving conditions of an elevator and FIG. 3 is a flow chart used to explain an elevator emergency operation control method according to one embodiment of the present invention.

First, referring to FIG. 2, the operation of an elevator may be typically divided into an acceleration zone, a constant speed zone, a creep zone and a seating zone. That is, the elevator has an operation pattern that the elevator is accelerated until it reaches a constant speed after it is started (acceleration zone), it holds at a constant target speed (constant speed zone), it is decelerated (creep zone) and it arrives at a destination (seating zone).

It is shown in the example of the figure that the elevator is moved at 20 m/min in the constant speed zone, 5 m/min in the creep zone and 2 m/min in the seating zone.

That is, the present invention can support an automatic operation control method of using such distinct operation status information of the elevator to minimize power consumption of the battery of the elevator in an emergency power situation.

In other words, if an emergency power situation occurs in the acceleration zone where the elevator is accelerated, it can be detected that the elevator is closer to a start point than a target destination, and accordingly, the elevator can be controlled to be backward operated to arrive at a near floor. For reference, in the specification and the drawings, for the operation direction of the elevator, it is assumed that a forward direction is a direction in which the elevator is moved previously and a backward direction is a direction opposite to the direction in which the elevator is moved previously.

In addition, if an emergency power situation occurs in a deceleration zone such as the creep zone or the seating zone, it can be detected that the elevator is closer to the target destination than the start point, and accordingly, the elevator can be controlled to continuously forward operated to arrive at the near floor.

However, if an emergency power situation occurs in the constant speed zone, a determination on whether to operate the elevator in the forward direction or in the backward direction has to be preceded. Details of a process of such a determination are shown in FIG. 3.

Referring to FIG. 3, if an emergency operation situation occurs during operation of the elevator (S310), it is determined whether or not the elevator is operated at a constant speed (S320). If it is determined that the elevator is in an acceleration operation state or in a deceleration operation state such as creep or seating, the operation direction of the elevator is determined as the corresponding backward direction or forward direction (S350) and then the elevator is operated in the determined operation direction (S360).

However, if it is determined at S320 that the elevator is in the constant speed state, the inverter (see FIG. 1) for supplying driving power to the elevator performs a forward test operation and a backward test operation. In other words, if the elevator is in a stopped state due to the occurrence of the emergency operation situation (S310) and it is determined at S320 that the elevator is in the constant speed state immediately before it is stopped, the inverter performs the forward test operation and backward test operation as shortly as possible for the elevator and measures power consumption for these test operations (S330).

Here, the power consumption measurement is preferably made by means of a current measuring sensor or the like contained in the inverter.

Then, a comparison in output current between the forward operation and the backward operation is made based on the power consumption measurement made by the current measuring sensor and the elevator operation direction is determined as a direction in which a smaller output current is consumed (S340).

Accordingly, if the elevator operation direction is determined as the forward direction, a process of performing the forward test operation and the backward test operation for the elevator and then again operating the elevator in the forward direction may be required.

On the contrary, if the elevator operation direction is determined as the backward direction, by making a comparison in output current between the forward test operation and the backward test operation for the elevator, it is possible to operate the elevator in the backward direction without a need to additionally stop the elevator.

The above-described elevator emergency operation method according to the embodiment of the present invention can be applied to an inexpensive elevator whose operation is controlled by an inverter including no load measuring sensor.

That is, the method of the present invention can be more effective in automatically setting an emergency operation direction to correspond to operation status information of the elevator in a situation where the current position of the elevator cannot be automatically detected, and operating the elevator in the set emergency operation direction. However, the method of the present invention is not limited to the inexpensive elevator including no load measuring sensor. For example, if information on the current position of the elevator can be automatically detected, the method of the present invention may be configured to determine a more reasonable elevator operation direction in association with the detected position information.

For example, if an elevator emergency operation situation occurs in the constant speed zone (S320), as a result of comparison in output current between the forward test operation and the backward test operation for the elevator, if it is determined that a difference in power consumption between the forward test operation and the backward test operation falls within a margin of error, the method of the present invention may be configured to additionally use the above-mentioned elevator position information.

In other words, if it is determined that the difference in power consumption between the forward test operation and the backward test operation of the elevator stopped in the constant speed zone falls within the margin of error, a controller such as the inverter may be configured to detect the current position of the elevator and determine the operation direction of the elevator as a direction in which the elevator is closer to a near floor, based on the detected current position. That is, the method of the present invention may be configured to operate the elevator in the forward direction when a position of the near floor in the forward direction is closer to the current position of the elevator, while operating the elevator in the backward direction when a position of the near floor in the backward direction is closer to the current position of the elevator.

However, this configuration is just illustrative and it is to be understood that the method of the present invention may be configured to operate the above-mentioned elevator including no load measuring sensor in a direction in which less power is consumed.

Figure 4:
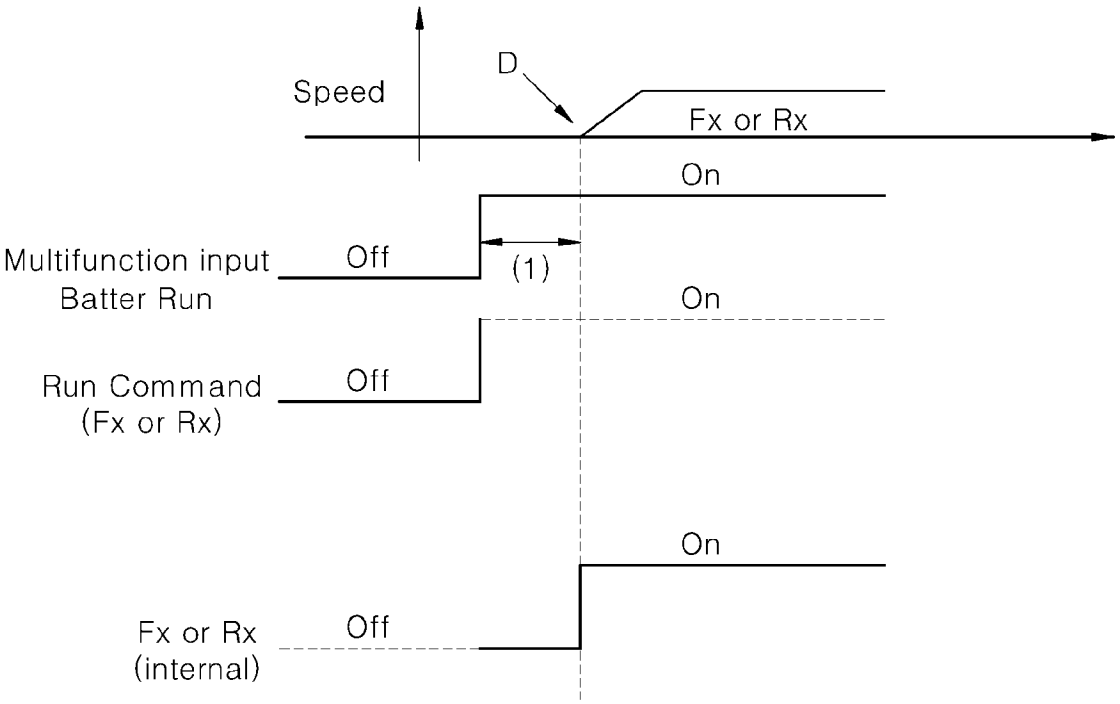
FIGS. 4 to 6 are views used to explain an operation sequence of an elevator according to the embodiment of FIG. 3.
Figure 5:
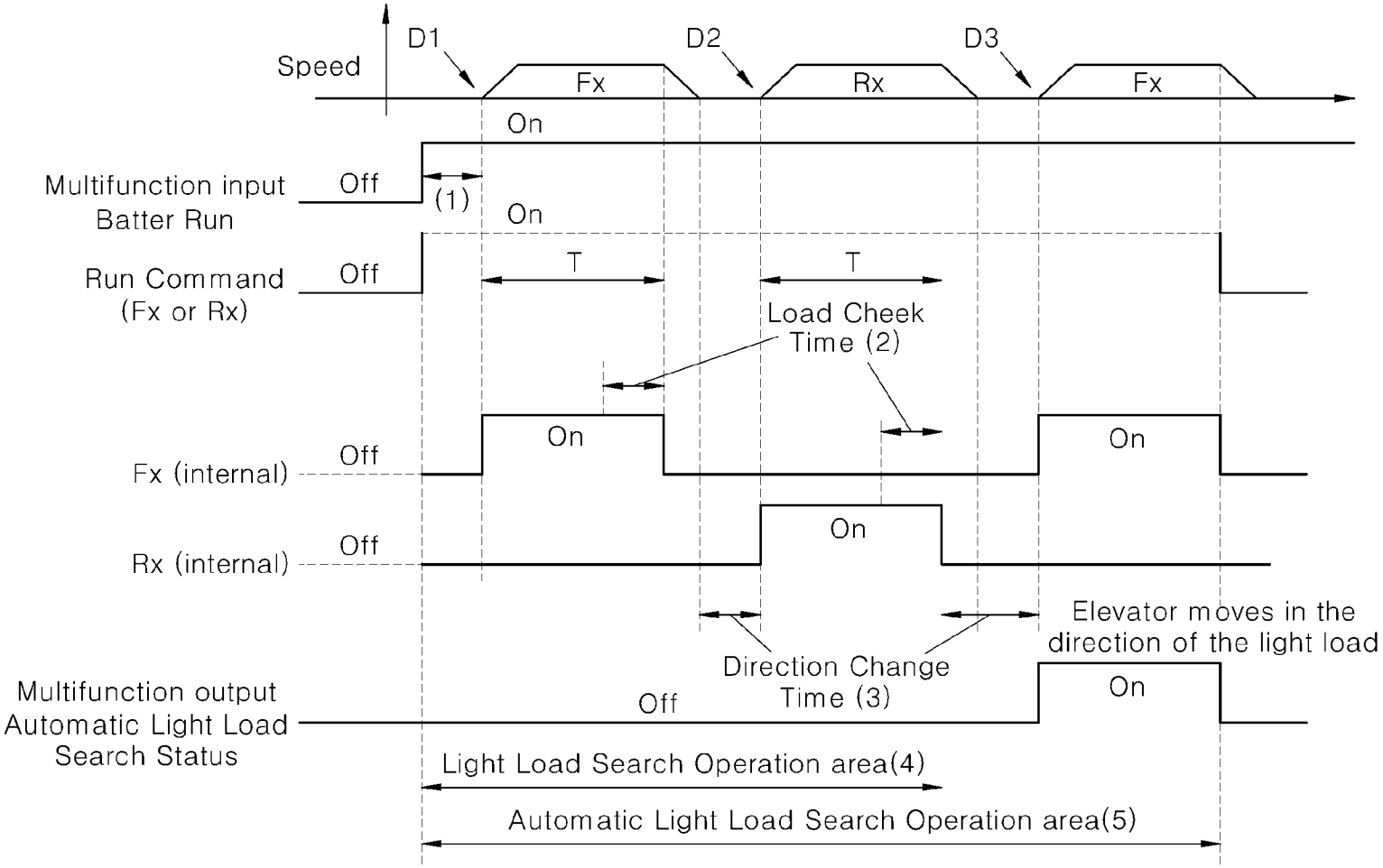
Figure 6:
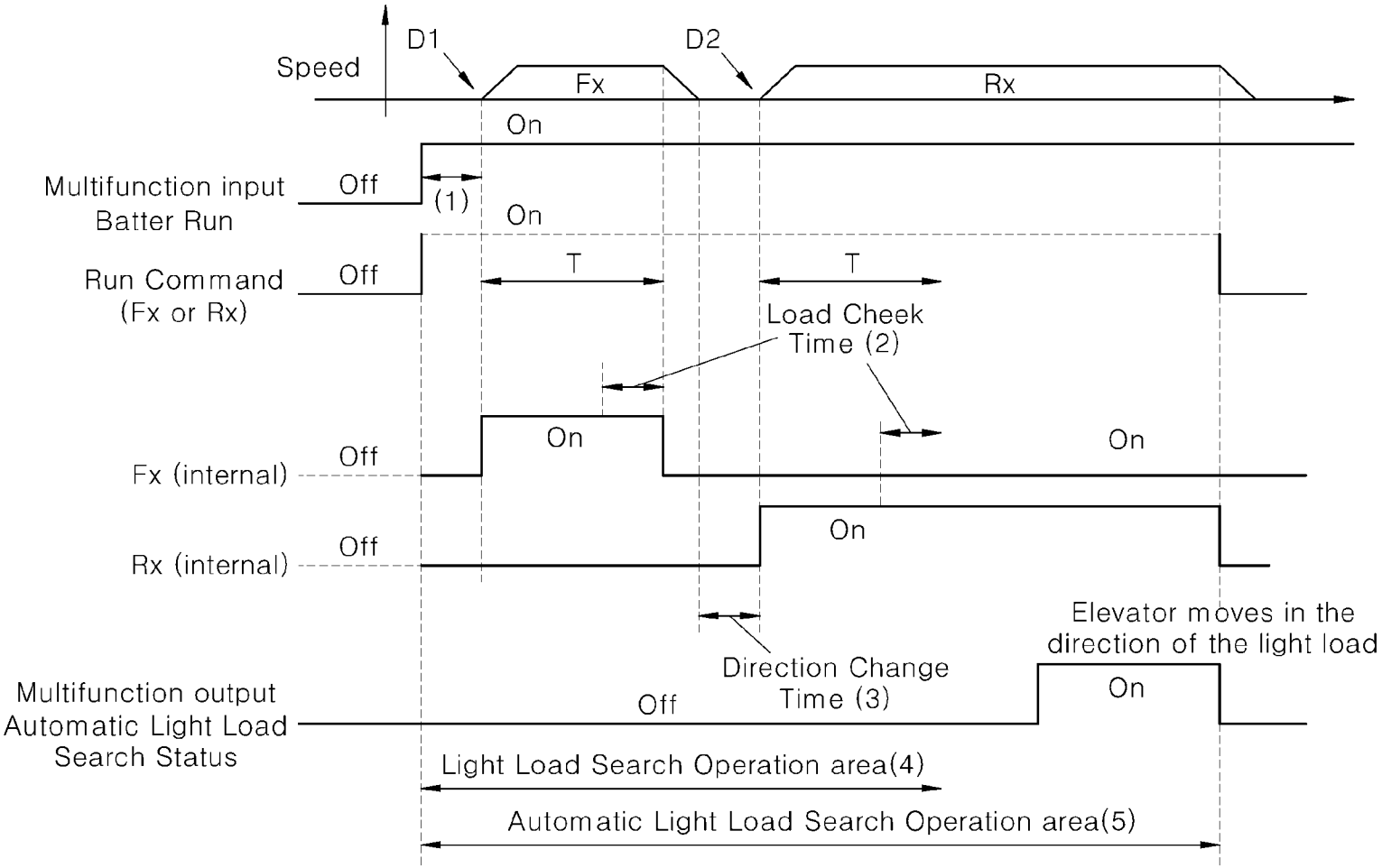

FIGS. 4 to 6 are views used to explain an operation sequence of an elevator according to the embodiment of FIG. 3. FIG. 4 shows an operation sequence in the acceleration zone, the creep zone and the seating zone and FIGS. 5 and 6 show an operation sequence in the constant speed zone.

First, referring to FIG. 4, when a battery operation signal (Battery Run) of multifunction input signals of the inverter is activated, a corresponding elevator operation (D) is performed after lapse of a certain time (1).

That is, a backward (Rx) operation control signal is supplied when the elevator is in the acceleration zone, and a forward (Fx) operation control signal is supplied when the elevator is in the creep zone or the seating zone. It is shown in the figure that a command signal (Run Command) for the backward or forward operation is in synchronization with the battery operation signal (Battery Run) and an internal signal (Internal) for the backward or forward operation is in synchronization with the elevator operation (D).

Next, FIG. 5 illustrates an operation when the forward operation is determined to consume a small current in the operation sequence in the constant speed zone.

Referring to FIG. 5, when a certain time (1) elapses after the battery operation signal (Battery Run) and the operation command signal (Run Command) are applied, an operation (D1) for the elevator forward test operation is performed and the elevator forward test operation is performed for a time (T). Subsequently, after a direction change time (3), an operation (D2) for the backward test operation is performed and the backward test operation is again performed for a time (T).

It is shown in the figure that the test operations are performed in synchronization with the internal signal (Internal) for the forward (Fx) and backward (Rx) directions and a load check interval (2) (Load Check Time) is included in each of test operation intervals for both directions.

That is, through the above process, the elevator is determined to be moved in a light load direction. FIG. 5 shows an operation sequence when the forward direction is the light load direction. It can be seen from the figure that an operation (D3) is performed in synchronization with an forward internal signal (Fx(internal)) in order to move the elevator in the forward direction determined as the light load direction and the operation is ended in synchronization with an automatic light load search status signal of multifunction output signals.

In other words, a test operation interval for each of the forward and backward direction after the occurrence of the battery operation signal may be set as a light load search operation area (4) and an operation interval in which the elevator is operated in the light load direction searched through the light load search operation area (4) may be set as an automatic operation area (5).

Finally, FIG. 6 illustrates an operation when the backward operation is determined to consume a small current in the operation sequence in the constant speed zone.

Referring to FIG. 6, when a certain time (1) elapses after the battery operation signal (Battery Run) and the operation command signal (Run Command) are applied, an operation (D1) for the elevator forward test operation of the elevator is performed and the elevator forward test operation is performed for a time (T). Subsequently, after a direction change time (3), an operation (D2) for the backward test operation is performed and the backward test operation is again performed for a time (T). However, in FIG. 6, unlike FIG. 5, since the backward is determined as a light load direction, the direction change is not performed again and the backward (Rx) operation of the elevator is subsequently performed.

In the same manner as described above, a load check interval (2) (Load Check Time) is included in each of test operation intervals for both directions, a test operation interval for each of the forward and backward direction after the occurrence of the battery operation signal may be set as a light load search operation area (4) and an operation interval in which the elevator is operated in the light load direction searched through the light load search operation area (4) may be set as an automatic operation area (5). In addition, in the same manner as described above, the backward operation of the elevator is ended in synchronization with an automatic light load search status signal of multifunction output signals.

As described above, in the specification and the drawings, for the operation direction of the elevator, the forward direction is defined by a direction in which the elevator is moved previously and the backward direction is defined by a direction opposite to the direction in which the elevator is moved previously.

In addition, as described above, in the present invention, the term 'emergency situation' or 'emergency power situation' refers to a situation where supply of commercial power using an inverter cannot be properly performed, that is, a situation where an auxiliary power supply such as a battery is used to supply driving power to an elevator.

While the present invention has been particularly shown and described with reference to exemplary embodiments thereof, it will be understood by those skilled in the art that various changes in form and details may be made therein without departing from the spirit and scope of the present invention. The exemplary embodiments are provided for the purpose of illustrating the invention, not in a limitative sense. Thus, it is intended that the present invention covers the modifications and variations of this invention provided they come within the scope of the appended claims and their equivalents.

What is claimed is:

1. A method for controlling an operation of an elevator, comprising:

detecting a current operation zone of an elevator when an auxiliary power supply driving situation occurs;

operating the elevator by using the auxiliary power supply to correspond to the detected current operation zone;

measuring an output current in a forward test operation for the elevator;

measuring an output current in a backward test operation for the elevator; and making a comparison in output current between the forward test operation and the backward test operation;

determining that a difference in output current between the forward test operation and the backward test operation falls within a margin of error; and determining the operation direction of the elevator as a direction in which the elevator is closer to a near floor, based on position information of the elevator, wherein the detected current operation zone corresponds to a constant speed zone.

* * * * *